US006786764B2

(12) United States Patent
Sivertsen

(10) Patent No.: US 6,786,764 B2
(45) Date of Patent: Sep. 7, 2004

(54) ADAPTERS, COMPUTER SYSTEMS, AND METHODS THAT UTILIZE A SIGNAL PASS-THROUGH

(75) Inventor: Clas G. Sivertsen, Lilburn, GA (US)

(73) Assignee: American Megatrends, Inc., Norcross, GA (US)

( * ) Notice: Subject to any disclaimer, the term of this patent is extended or adjusted under 35 U.S.C. 154(b) by 0 days.

(21) Appl. No.: 10/355,910

(22) Filed: Jan. 31, 2003

(65) Prior Publication Data

US 2004/0152357 A1 Aug. 5, 2004

(51) Int. Cl.[7] ..... H01R 11/00
(52) U.S. Cl. ..... 439/502; 439/638
(58) Field of Search ..... 439/502, 638

(56) References Cited

U.S. PATENT DOCUMENTS 5,192,226 A * 3/1993 Wang ..... 439/502
5,340,331 A * 8/1994 Bohlen et al. ..... 439/502
5,954,538 A * 9/1999 Huang ..... 439/502
6,071,150 A * 6/2000 Tang et al. ..... 439/638
6,174,206 B1 * 1/2001 Yentile et al. ..... 439/638
6,498,890 B1 * 12/2002 Kimminau ..... 385/134

* cited by examiner

*Primary Examiner*—Gary Paumen
(74) *Attorney, Agent, or Firm*—Merchant & Gould

(57) ABSTRACT

Adapters, computer systems, and methods utilize a signal pass-through for input devices to the computer system. The pass-through occurs through an adapter for the computer system that provides a housing having a first and second connector. The first connector can be connected to the input connector of the computer, such as a PS/2 connector. The second connector can be connected to a connector of the input device, such as another PS/2 connector. A cable extends from the housing so that signals from the input device are transferred through the second connector and away from the housing while signals to the computer are transferred to the housing and ultimately through the first connector to the computer. Another device, such as a network device, may be connected to the other end of the cable to receive the input device signal, receive input signals from other sources such as a network, and then deliver an input signal back to the computer through the cable and first connector.

20 Claims, 10 Drawing Sheets

| PS/2 MALE | | PS/2 FEMALE | |
|---|---|---|---|
| PIN | SIGNAL | PIN | SIGNAL |
| 1 | HOST_DATA # | 1 | LOC_DATA # |
| 2 | N/C | 2 | N/C |
| 3 | GND | 3 | GND |
| 4 | +5V | 4 | +5V |
| 5 | HOST_CLK # | 5 | LOC_CLK # |
| 6 | N/C | 6 | N/C |

ADAPTERS, COMPUTER SYSTEMS, AND METHODS THAT UTILIZE A SIGNAL PASS-THROUGH

TECHNICAL FIELD

The present invention is related to signal transfer from input devices to a computer. More particularly, the present invention is related to adapters of a computer system that provide input signal pass-through for multiple input devices.

BACKGROUND

Computer users utilize input devices to provide control over functions of the computer. For example, a computer user provides input to computer programs through typing on a keyboard or moving a mouse. In certain situations, the input to the computer should come from a source other than a local input device connected to the computer. For example, an additional external device may be present to provide input to the computer that is independent of the local input device.

To allow such an external device to provide input, it is necessary to couple the inputs of the external device and the local input device in some way. Typically, the local input device and the external device must utilize the same input connection of the computer to provide the input signals to the computer. For instance, the external device may be used to supersede the inputs of the local input device so that the external device intercepts the input signals from the local input device.

Providing a coupling between the local input device, the external device, and the input connection of the computer may require that the local input devices not be connected in a location where they would ordinarily be. This unconventional installation may confuse users. Additionally, input signals must be passed from the local input device to the external device and from the external device to the computer so that the external device may intercede, and this may result in unpleasant cable clutter.

SUMMARY

Embodiments of the present invention address these and other problems by providing an adapter for use in the computer system to couple the local input device and the external device to the input connection of the computer. The adapter has a housing with a connector that may be connected to the input port of the computer while the user input device is connected to another connector on the housing. Furthermore, one cable extends from the housing to the external device. The cable has wires to carry the signals of the local input device to the external device and carry signals from the external device back to the housing and ultimately to the computer input.

One embodiment is an adapter for use between a computer and a computer input device. The adapter includes a first connector housing and a first connector on a first end of the housing. The first connector includes at least one conductor and is connectable to a connector of a computer. A second connector is on a second end of the housing, and the second connector includes at least one conductor and is connectable to a connector of a computer input device. A cable extends from the first connector housing, and the cable includes a first wire in electrical continuity with the at least one conductor of the first connector and includes a second wire in electrical continuity with the at least one conductor of the second connector.

Another embodiment is a computer system that includes a computer having at least one input connector and an input device having at least one connector. The computer system also includes an adapter that has a first connector housing and a first connector on a first end of the housing. The first connector includes at least one conductor and is connected to the at least one connector of the computer. A second connector is on a second end of the housing, and the second connector includes at least one conductor and is connected to the at least one connector of the input device. A cable extends from the first connector housing, and the cable includes a first wire in electrical continuity with the at least one conductor of the first connector and includes a second wire in electrical continuity with the at least one conductor of the second connector.

Another embodiment is a method of passing input signals between a local input device, an external device, and a computer. The method involves providing an adapter having a first housing with a first connector, a second connector, and a cable with a first wire associated with the first connector and a second wire associated with the second connector. The first connector is connected to an input connector of the computer, and the second connector is connected to a connector of the input device. The first wire and second wire are in electrical continuity with circuitry of the external device. An input signal is transferred from the local input device through the second connector to the second wire and an input signal is transferred from the external device through the first wire to the first connector.

DETAILED DESCRIPTION

Embodiments of the present invention provide for the pass-through of input signals from a local input device for a computer system to another external device and the pass-through of input signals from the other external device back to the computer system. These embodiments allow the computer, local input device, and other external device to be coupled so that the computer may be responsive to both the local input device and the other external device while simplifying the required connections and amount of cable clutter. These embodiments are discussed below in more detail with reference to FIGS. 8–12. Prior to discussing these embodiments of the present invention, a typical operating environment for these embodiments will be discussed in detail. This discussion is intended only to provide an example of how embodiments of the present invention may be utilized and is not intended to be limiting in any way. For instance, embodiments of the present invention do not require that a network be present or that any remote communications occur.

Local computers may be managed remotely through external devices described herein so that the system manager or other user need not be physically present with the local computer but instead views screen displays and interacts with the local computer through a remotely located computer. For example, the user can remotely view screen frames being produced by the local computer to determine whether the local computer has crashed or whether the local computer is executing a particular application. Additionally, the end user may operate a user input device of the remote computer such as a mouse or keyboard, and the user input is transferred to the local computer where it can be implemented.

Figure 1:
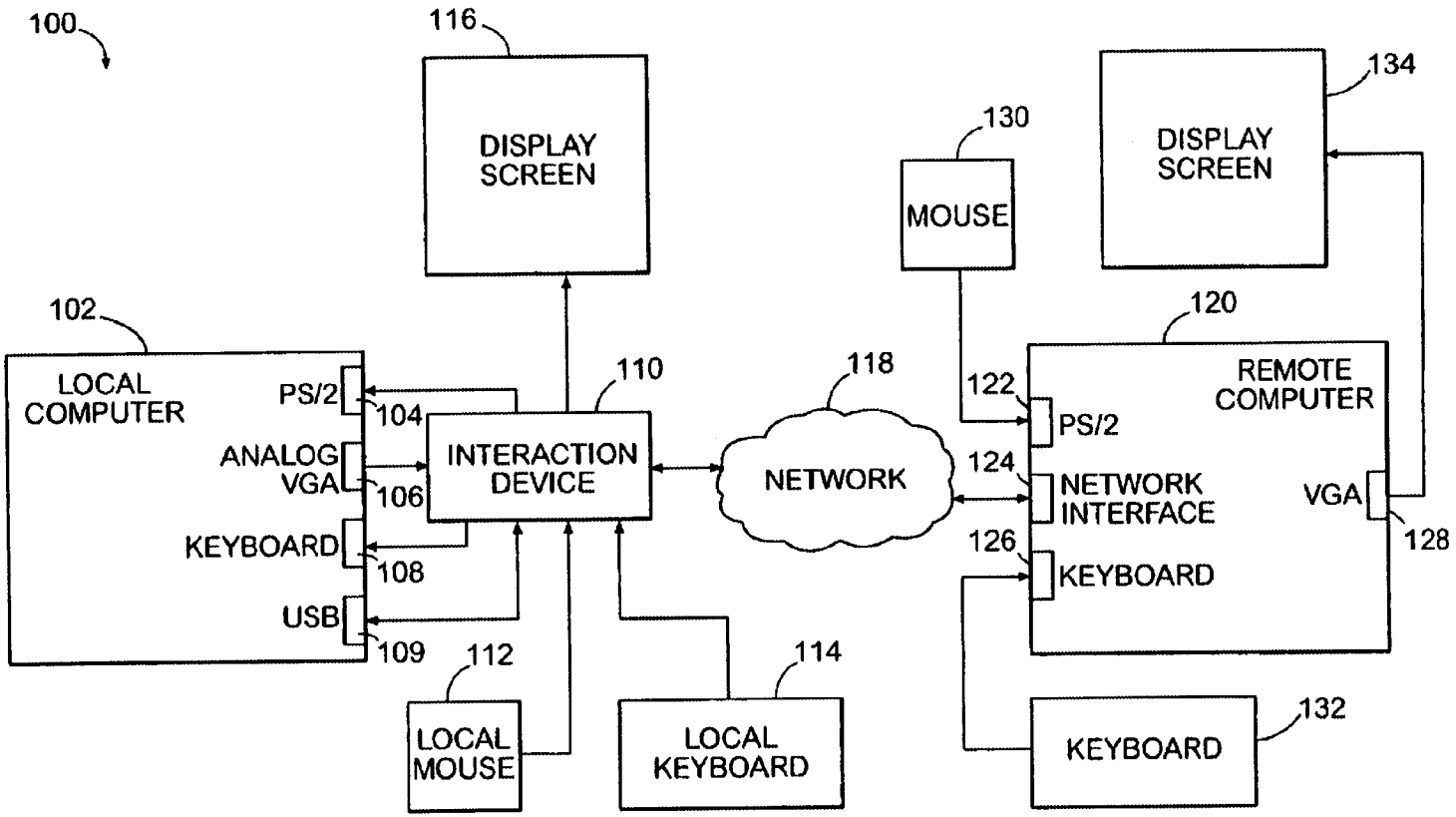
FIG. 1 illustrates a network based operating environment a device that allows a remote computer to display screen frames of a local computer and provide user interaction with the screen frames.

An environment for application of such an external device is shown in FIG. 1. The environment generally includes a local computer 102 that is to be remotely managed. An interaction device 110 is disposed between a network 118 and the local computer 102. A remote computer 120 is linked to the network 118, and the local computer 102 may or may not be linked to the same network 118 or another network not shown. The network 118 may be of various forms such as a local area-network ("LAN") or wide area network ("WAN") including the Internet. A user is located at the remote computer 120 and remotely manages the local computer 102 via the network 118 and interaction device 110.

The interaction device 110 may be linked to the local computer 102 through several input/output ("I/O") connections of the local computer 102. Generally, a local computer 102 will have a video display output 106, such as an analog or digital VGA output. Also, the local computer 102 typically includes a PS/2 port or ordinary serial port configured as a mouse port 104, a keyboard port 108, and may also or alternatively include a universal serial bus ("USB") port 109.

The video display output 106 provides a signal that ordinarily is passed directly to a display screen or monitor 116 where screen frames are displayed for a user present at the local computer 102. However, in the embodiment shown, the video display output 106 provides a video signal to a video input of the interaction device 110. The interaction device 110 then passes the video signal through a video output to the display screen 116 where a normal video display of screen frames occurs. The details of the interaction device 110 and its operations upon the video signal are provided below with reference to FIGS. 2–4.

User input devices may also be provided for the local computer 102, including a local mouse 112 and local keyboard 114. Conventionally, the local mouse 112 and local keyboard 114 would be directly connected to the mouse port 104 and keyboard port 108 of the local computer 102. However, for the embodiment shown, the local mouse 112 and local keyboard 114 are connected to a mouse port and keyboard port, respectively, of the interaction device 110 and provide mouse and keyboard data to the interaction device 110 through these connections. The interaction device 110 then passes the mouse data and keyboard data to the respective ports of the local computer 102.

In addition to providing the pass-through of the video signal to the display screen 116, the interaction device 110 captures screen frame data from the video signal and transfers the screen frame data across the network 118 to the remote computer 120. The remote computer 120 has a network interface 124 linking the remote computer 120 to the network 118. The network interface 124 used by the remote computer 120 may be of various forms such as a dial-up modem or an Ethernet connection to a LAN. Various protocols of data transfer may be utilized between the interaction device 110 and the remote computer 120, such as the TCP/IP protocol ordinarily used via the Internet.

The remote computer 120 implements an application, such as a dedicated application or general purpose browser window such as a web browser, for receiving the screen frame data through the network interface 124 and providing a display on the display screen 134. The display includes the screen frame produced by the local computer 102 that corresponds to the screen frame data transferred by the interaction device 110. Typically, the remote computer 120 includes a video adapter that has a video output 128 connected to the display screen 134 to provide the video signals.

To allow the user of the remote computer 120 to fully interact with the local computer 102, user interface devices such as a mouse 130 and keyboard 132 are connected to a mouse port 122 and keyboard port 126, respectively, of the remote computer 120. The user manipulates the mouse 130 and keyboard 132 to interact with the screen frame shown on the display screen 134, which may be formed wholly or in part by the screen frame data received over the network 118. When the user activity at the remote computer 120 is entered with respect to the screen frame data received from the interaction device, then the processing device of the remote computer 120 transfers the user activity data over the network 118 to the interaction device 110 that passes it to the mouse port 104 and/or keyboard port 108.

Once the local computer 102 receives the user activity data through the mouse port 104 and/or keyboard port 108, the local computer 102 then implements the user activity as if it had occurred through the local mouse 112 or local keyboard 114. When implemented, the user activity alters the screen frame to be displayed. Therefore, the video signal output by the video connector 106 to the interaction device 110 provides the screen frames that show the change caused by the user activity at the remote computer 120, such as the mouse pointer moving or letters appearing in an electronic document.

The interaction device 110 transfers the screen frame data showing the user activity to the remote computer 120 where it is then provided to the display screen 134. Thus, the user activity initially performed at the remote computer 120 is represented on the display screen 134 immediately as it is being performed by the user and then once again after updating the video display of the local computer 102 and transferring the updated screen frame back to the remote computer 120.

As processing and propagation delays decrease within the environment 100, the initial and subsequent-display of the same user activity (i.e., multiple cursors or mouse pointers) on the display screen 134 converge in time so that the user sees only one change. For example, moving a mouse pointer within the local computer screen frame shown on the display screen 134 may appear immediately as the user performs the activity and then later reappear such as a ghost movement once the screen frame update is received. However, as delays are reduced, for example by Giga-bit per second network transfer rates, the initial and subsequent mouse pointer movements converge to one movement as perceived by the user of the remote computer 120. Furthermore, as discussed below, the mouse over window option may be turned off for a browser window so that only a single mouse cursor is shown at all times, regardless of propagation delays.

In addition to receiving user input, the interaction device 110 may also provide for additional interaction with the remote computer 120 by providing a USB connection to a USB port 109 of the local computer 102. The USB connection allows the interaction device 110 to emulate USB devices for the local computer 102, such as additional storage devices including devices that the local computer 102 may use when booting-up. For example, the remote computer 120 may provide a floppy, CD-ROM, or hard disk drive that contains a boot-up sequence to be used by the local computer 102. Upon a connection being established over the network 118 between the interaction device 110 and remote computer 120, the local computer 102 may boot from a media source of the remote computer 120 with the boot-up sequence provided through the USB port 109.

The USB connection form the interaction device 110 may also allow a local keyboard and mouse and/or a keyboard and mouse of the remote computer to be emulated for the local computer 102. For example, the local computer 102 may have only USB ports instead of PS/2 ports and the interaction device 110 outputs mouse and keyboard signals to the local computer through the USB connection.

Figure 2:
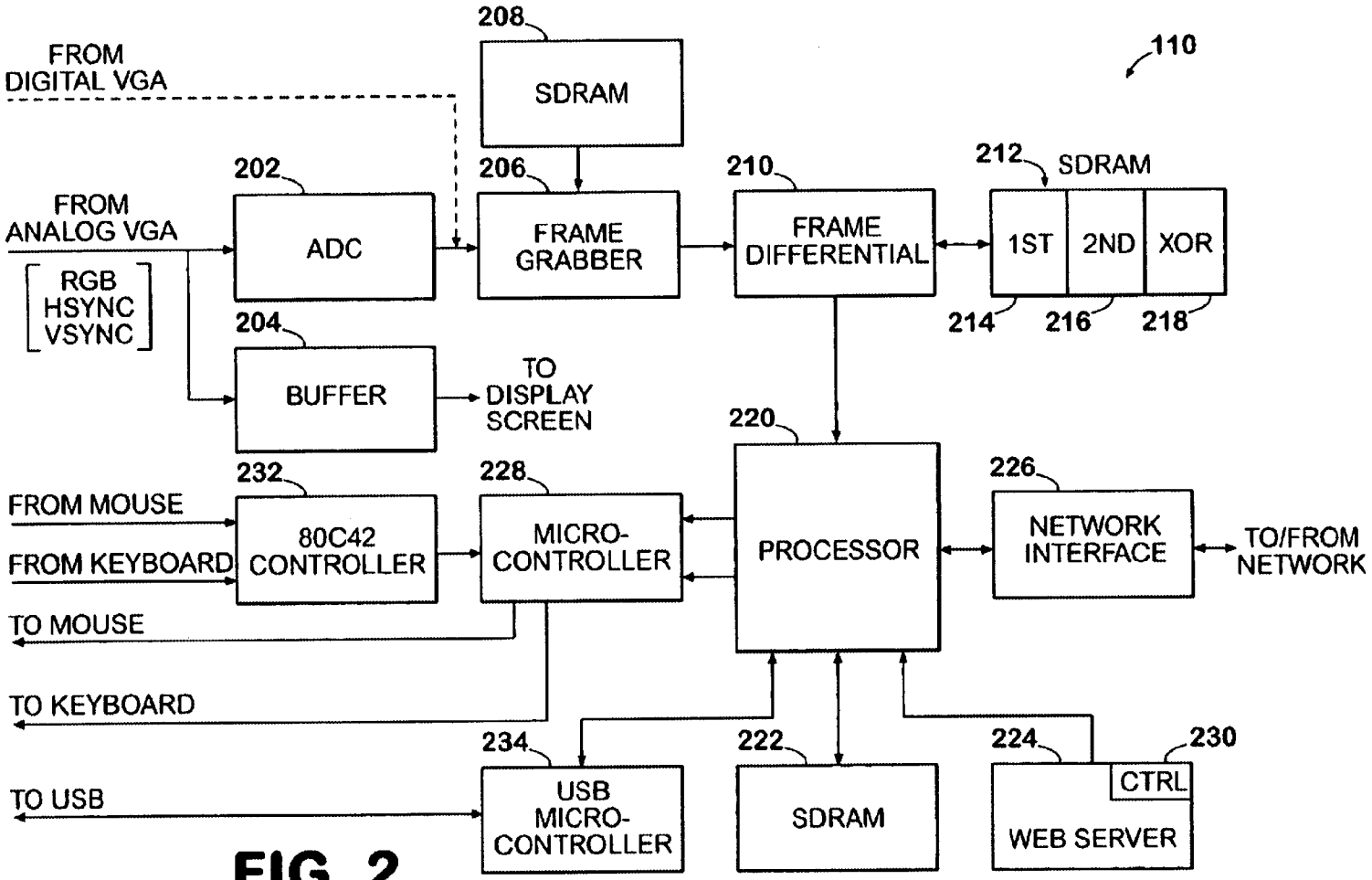
FIG. 2 shows the functional components of the device of FIG. 1.

FIG. 2 shows the major components of one embodiment of the interaction device 110 of FIG. 1. This embodiment of the interaction device 110 includes an analog to digital converter 202 and a video buffer 204, and both of these receive the analog VGA video signal from the local computer 102. The analog VGA signal includes five distinct signals, including a red drive, a blue drive, a green drive, a horizontal synchronization pulse, and a vertical synchronization pulse. The video buffer 204 conditions the video signal through amplification and outputs it to the display screen 116 so that splitting the video signal between the converter 202 and the display screen 116 does not degrade the signal and the resulting display.

The converter 202 digitizes the video signal including the five distinct signals. The converter 202 then outputs the digitized video signal to a frame grabber 206. As one alternative, a digital video output of the local computer 102, if available, could be provided to the frame grabber 206 in place of the analog video signal that has been digitized as described above. The frame grabber 206 takes the portion of the digitized video signal corresponding to one screen frame and outputs that portion of the digitized signal as discrete screen frame data. The converter 202 and frame grabber 206 may be separate components or may be incorporated as one component. For example, an LCD controller may be used as a frame grabber 206 to capture the screen frame data.

The screen frame data is utilized by a frame differential component 210 to compute a difference between screen frame data of a current screen and a screen frame data of an immediately preceding screen frame. The frame differential component 210 maintains a previous screen frame data in a first memory location 214 in SDRAM 212 and maintains the current screen frame data in a second memory location 216. The frame differential component 210 then executes an exclusive OR ("XOR") Boolean operation upon the two sets of screen frame data to indicate where the changes have occurred between the two. The result of the XOR operation is stored in a third memory location 218.

The frame differential component 210 provides the screen frame data to a processing device 220 so that it may be transmitted. The screen frame data 210 may be either the entire screen frame data of the most current screen frame grabbed from the digitized video signal, or may be the screen frame data making up the difference detected by the XOR operation described above. Providing only the screen frame data representing the difference between the current screen frame and the preceding screen frame results in less data being distributed over the network 118.

Additional filtering functionality of the frame differential component 210 that is applicable when the analog video is digitized to reduce the-amount of unnecessary data transfer may also be included, such as applying threshold comparisons to the most current screen frame data to determine whether to send the results of the XOR operation or send no new screen frame data. The threshold of this filtering component may be set as desired. As an example, the filter may look apply a 7 bit per pixel threshold to determine whether the screen frame data has had a significant change worth transmitting or only contains sampling noise where an analog to digital converter is used. When changes in the current screen frame data are significant as determined by the threshold, then the result of the XOR may be transmitted. The frame differential component 210 may be implemented in various ways, including a programmable logic device such as an field programmable gate array or application specific integrated circuit that is configured to implement the XOR operations and provide the result to the processing device 220.

The processing device 220 interacts with the frame differential component 210 to access the screen frame data to be provided to a network interface device 226. The processing device 220 may be implemented in various ways discussed above, such as but not limited to the PowerPC® 405GPr general purpose reduced instruction set processor manufactured by IBM® Corp. The processing device 220 employs logic to package the screen frame data for transfer by the network device 226 via a particular protocol, such as TCP/IP.

The screen frame data may be packaged for distribution by the processing device 220 from a network node established by the processing device 220 through the network interface 226. As one alternative, the processing device 220 in association with the network interface 226 may implement logic to behave as a web server 224 having a particular IP address for the network 118. The web server 224 provides the screen frame data as a resource that can be requested by a remote computer 120 through the network 118 by accessing the IP address of the web server 224 via a dedicated or generic browser window, such as a web browser like Internet Explorer by Microsoft®.

The screen frame data may be utilized by the browser window of the remote computer 120 in various ways. As an example, the browser window may be used to download the screen frame data in a continuous streaming manner and the screen frame data may be incorporated for display on the screen 134 by a dedicated application program of the remote computer 120. As another example, the browser window of the remote computer 120 may download the screen frame data in a continuous streaming manner for display of the screen frames on the screen 134 within the browser window itself such as where the browser window is a web browser. The browser window may implement browser commands of plug-in logic dedicated for a particular operating system platform such as an Active X® control to display the screen frames, or alternatively may implement a virtual machine that runs system independent browser commands such as a JAVA™ applet.

The processing device 220 interacts with SDRAM 222 to perform the processing operations including receiving the screen frame data and packaging the data for transfer by the network interface 226. Generally, the processing device 220 or network interface includes a media access control ("MAC"). The MAC obtains carrier access within a network to transmit the packets of the screen frame data and/or browser commands for physical layer transfer by the network interface 226. The network interface 226 may be of various forms such as a dial-up, digital subscriber line, ISDN, or cable modem or an Ethernet transceiver directly linked to a data network. The data is transferred from the transceiver of the network interface 226 via the network 118 to the appropriate IP address of the network interface 124 of the remote computer 120.

In addition to transferring the screen data to the remote computer 120 via the network 118, the network interface 226 also receives data transferred from the remote computer 120 over the network 118. The network interface 226 receives the request for screen frame data that occurs once the remote computer's browser has been directed to the IP address of the web server 224 of the interaction device 110. An example of a network interface 226 is a "phy" such as model LXT972A manufactured by Intel® Corp.

Additionally, the network interface 226 may receive data from the remote computer 120 that is indicative of the user activity occurring on the user interface devices of the remote computer 120. As discussed above, the end user may interact with the local computer screen frame being displayed on the screen 134 of the remote computer 120 by using the mouse and keyboard when the focus of the remote computer 120 is within the browser window display. The browser commands receive the user input of the user interface device and generate data corresponding to the user input relative to the local computer screen frame. The data is transmitted to the interaction device 110.

The interaction device 110 receives the data indicating the user activity through the network interface 226 where it is unpackaged from its transmitted state back to data that can be interpreted by the processing device 220. The processing device 220 receives the data describing the user activity that took place through the user interface devices of the remote computer 102. The processing device 220 then outputs a user interface command to a microcontroller 228 that arbitrates between the user input received over the network and the local user input received through a bus connection to an 80C42 compatible keyboard/mouse controller 232 that is coupled to the local mouse and keyboard. The microcontroller 228 may arbitrate by giving priority to one of the inputs where both the local and remote user input is received simultaneously to produce a clock and data output that is sent to the mouse or keyboard port of the local computer 102. In many instances, it may be appropriate to give the user input received over the network connection priority over local user inputs.

The local computer 102 implements the user activities transferred to the interaction device 110 over the network 118 as if they occurred through the user interface devices (i.e., mouse 112 and/or keyboard 114) directly coupled to the interface device 110. The user interface data provided as signals from the mouse or keyboard ports of the microcontroller 228 to the mouse port 104 or keyboard port 108 of the local computer 102 appear as ordinary mouse and keyboard data and clock signals.

To establish the USB connectivity discussed above between the interaction device 110 and the local computer 102, a USB microcontroller 234 may be included. The USB microcontroller 234 communicates with the processing device 220 to emulate a USB node for the local computer 102. Thus, a media source of the remote computer may be accessible by the local computer 102 by the USB microcontroller 234 emulating a USB media device for the local computer 102. Also, as discussed above, the USB microcontroller 234 may allow the emulation of a keyboard and mouse for the USB input of the local computer 102 to pass local and/or remote keyboard and mouse signals to the local computer 102.

Figure 3:
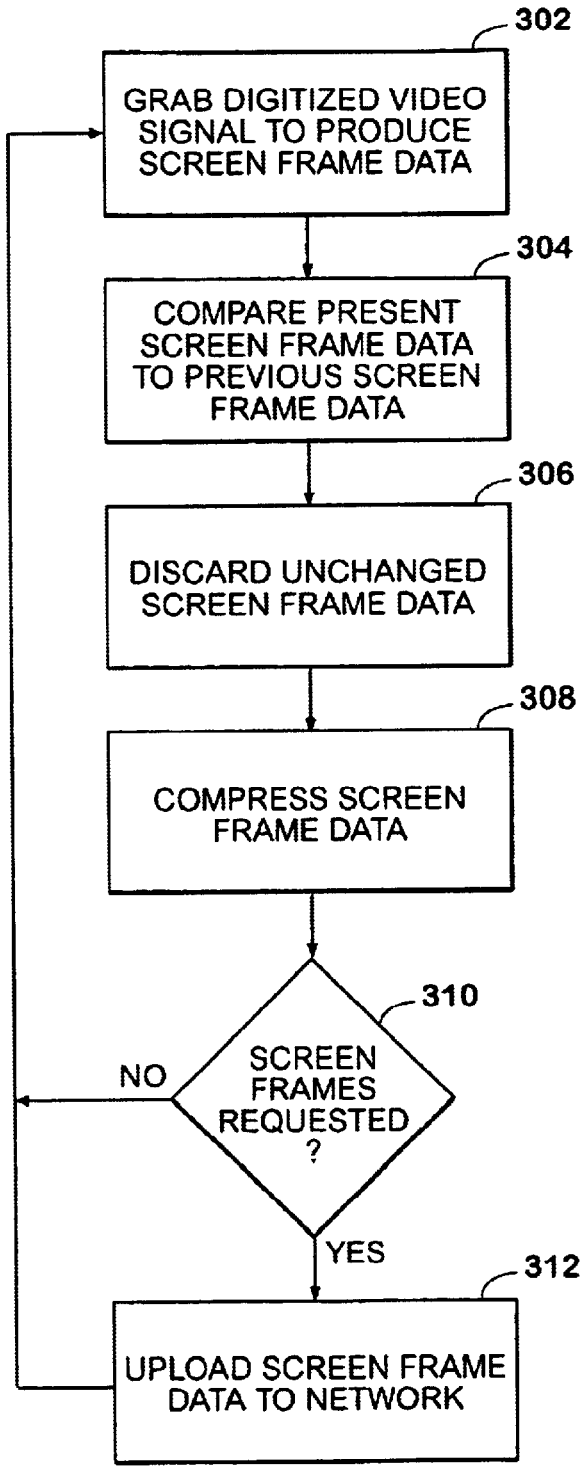
FIG. 3 depicts the logical operations of the device of FIG. 2 for obtaining screen frames from a local computer that may then be transmitted to a remote computer for display.

FIG. 3 shows logical operations that may be performed by the components of the interaction device 110 to provide screen frames of the local computer 102 to the remote computer 120. The operations begin at frame operation 302 where the frame grabber 206 grabs a screen frame for the digitized video signal. As mentioned above, the digitized video signal may be produced by an analog to digital converter or may be taken directly from a digital video output of the local computer 102 if available.

Once a screen frame has been obtained, the difference between the current screen frame data and the previous screen frame data is found through the filtering and/or XOR function as discussed above at comparison operation 304. The unchanged screen frame data can be discarded since it has already been transferred over the network 118 for the previous screen frame. As discussed above, an alternative to detecting the changes from one screen frame to the next is to always transfer the entire screen frame data rather than only the changes, but additional network bandwidth will be utilized by the larger data transfers. Also, as discussed above, rather than always sending the result of the XOR function, a threshold filter may be applied first to determine whether the current screen frame data has a significant change (e.g., greater than 7 bits of variation for a pixel value) to decide to send no screen frame data when the change is less than the threshold or to send the result of the XOR between the first and second screen frame data sets when the change is greater than the threshold.

After the screen frame data that is to be transferred has been obtained, the screen frame data may be compressed at compression operation 308. The screen frame data may be compressed through any one of various compression schemes to further reduce the amount of data to be transferred. The compression scheme may be programmed into either the frame differential component 210 or the processing device 220. Alternatively, the screen frame data may be transferred without being compressed, but additional network bandwidth will be utilized due to larger data transfers.

Query operation 310 of the web server 224 detects whether screen frames have been requested by an attempt to access the IP address of the web server 224 for the network 118. Once screen frame data has been requested, the current screen frame data that has been obtained and compressed is uploaded from the web server 224 over the network 118 at upload operation 312. The data is directed to the IP address of the remote computer 120 that addressed the web server 224. Additionally at upload operation 312, the control information 230 including browser commands such as a JAVA™ applet or Active X control may be transferred from the web server 224.

Figure 4:
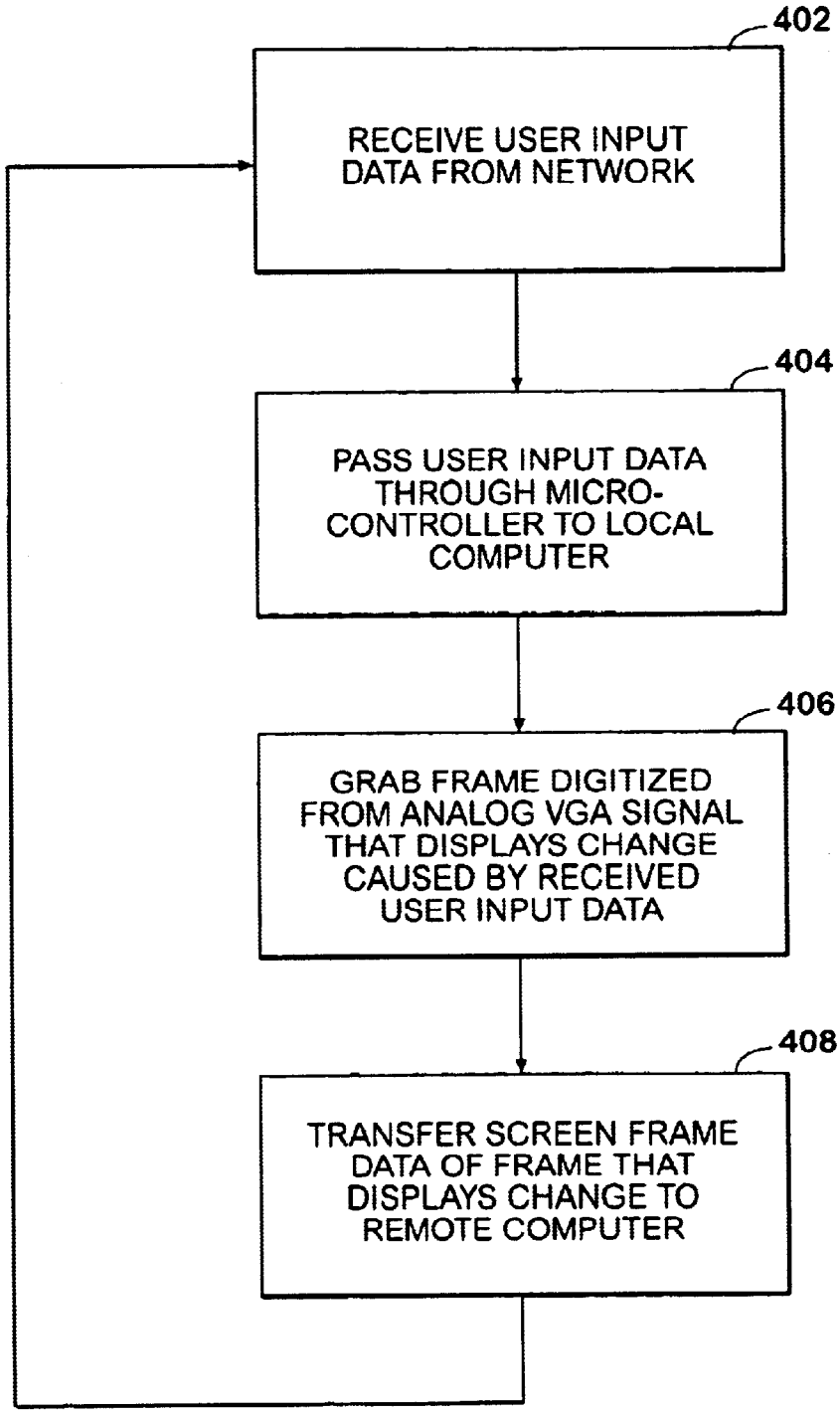
FIG. 4 shows the logical operations of the device of FIG. 2 for allowing user activity occurring at the remote computer to be implemented at the local computer.

FIG. 4 shows the logical operations performed by the interaction device 110 to provide a user of the remote computer 102 the ability to interact with the local computer 102. The processing device 220 receives the user input data from the network 118 at input operation 402. The user input data is generally produced by the browser commands as a result of the user manipulating the mouse 130 or keyboard 132 in relation to the screen frame being displayed within the browser. As discussed above, the browser commands that detect the user input and produce the user input data may be a plug-in to the browser window or may be an applet that is distributed to the browser when screen frame data is initially requested.

Upon receiving the user input data from the network 118, the processing device 220 instructs the microcontroller 228 to provide mouse or keyboard data signals corresponding to the user input data to the local computer 102 at controller operation 404. Thus, the processing device 220 formulates an instruction to the microcontroller 228 to move the mouse pointer, perform a mouse click, or to enter keyboard entries as appropriate at the local computer 102.

During this time, the interaction device 110 continues to grab screen frames and transfer them to the remote computer 120. During and after implementing the mouse and keyboard activity received through the network 118, screen frames are obtained at frame operation 406 that display the change that has been implemented due to the user activity at the remote computer 120. For example, if the user activity is mouse pointer movement, then the succession of captured screen frames show the movement of the mouse pointer.

At transfer operation 408, the screen frame data that which shows the user activity is transferred from the interaction device 110 to the remote computer 120. The remote computer 120 then updates the screen frame being displayed within the browser window. As previously discussed, this loop may result in artifacts such as multiple mouse pointers on the screen frame but as propagation and processing delays decrease, the immediate and delayed changes to the screen frame converge in time so that the artifacts are no longer perceivable. Also, the mouse over window option may be turned off at the remote computer for the browser window displaying the screen frames.

The process of updating the screen frame, receiving additional user input, transferring the user input for implementation by the local computer 102, and again updating the screen frame continues until the remote computer 120 no longer accesses the interaction device 110. This continuous loop allows the user of the remote computer 120 to interact with and manage the local computer 102.

Figure 5:
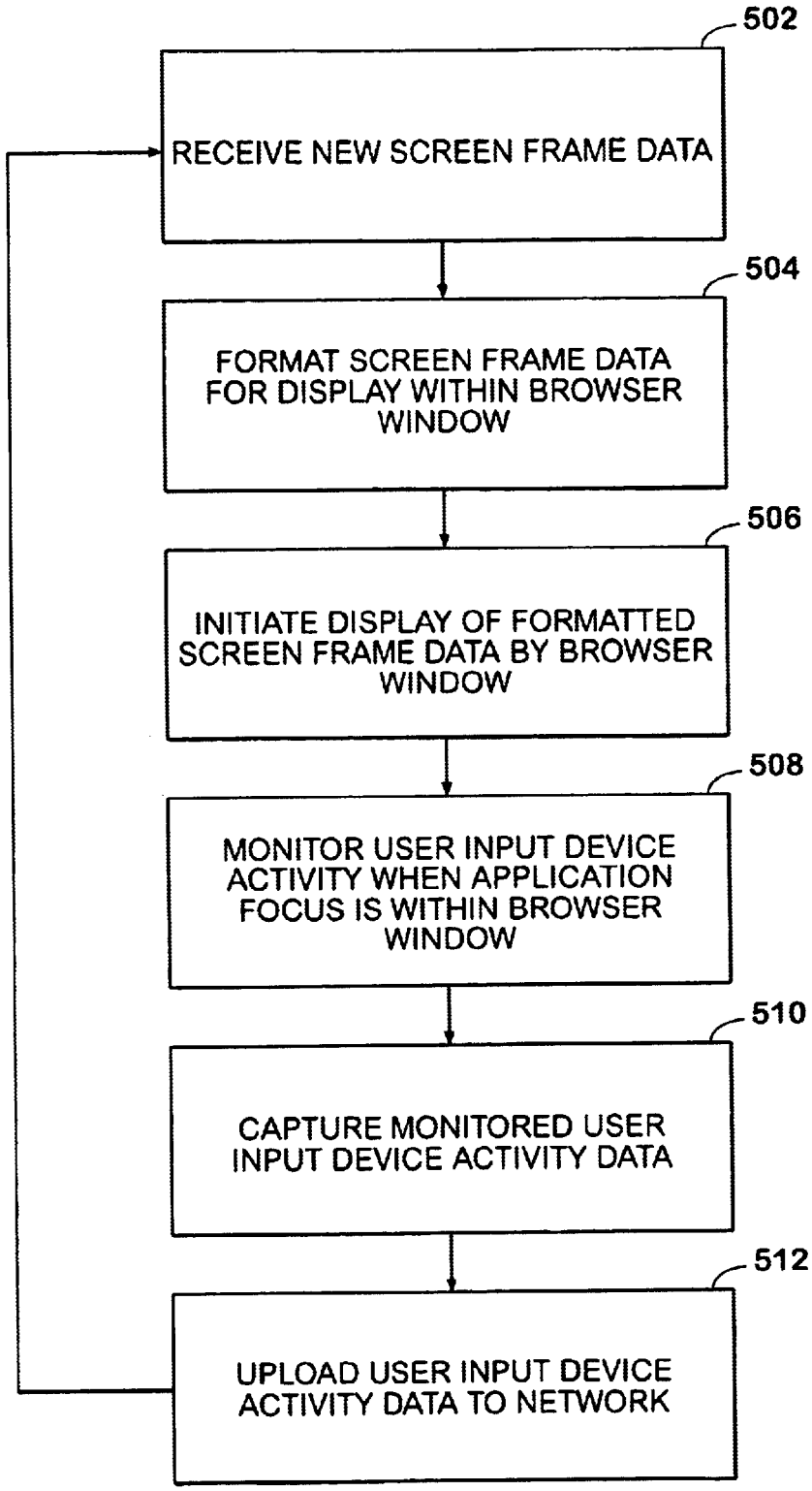
FIG. 5 illustrates the logical operations occurring at the remote computer for allowing screen frames of the local computer to be displayed at the remote computer.

Illustrative logical operations performed by the remote computer 120 to receive and display the screen frames of the local computer 102 are shown in FIG. 5. The remote computer 120 receives the most current screen frame data from the network 118 at receive operation 502. The remote computer 120 receives the screen frame data through the network interface 124 which provides the data to a processor that implements a dedicated application or browser window for displaying the screen frame.

The processor implementing the browser window formats the screen frame data for display within the browser window at format operation 504 by execution of the browser commands discussed above. Formatting the data involves either adapting the screen frame data for full screen display at the resolution provided by the remote computer 120 or for display within a GUI window on the display screen 134 with corresponding scroll bars for the window if necessary. The processor of the remote computer 120 then initiates display of the formatted screen frame data by the browser window at display operation 506.

The browser window implementing the browser commands then monitors for user activity within the screen frames being displayed by the browser window at monitor operation 508 whenever the browser window is the active focus of the GUI. When activity is detected, the browser commands cause user activity to be recorded at capture operation 510. Recording the user activity involves recording the mouse pointer movement and mouse clicks along with the relative coordinates of the mouse pointer within the screen frame. For example, if the mouse pointer is positioned at a particular location on the screen frame and is moving in a particular direction, the recorded user activity data includes both the location of the pointer relative to the coordinates defining the screen frame and the movement characteristics such as speed and direction. Additionally, recording the user activity involves recording the position of the cursor within the screen frame and any typing that occurs for the cursor position.

The browser commands then continually upload the user input data to the IP address of the web server 224 at upload operation 512. As discussed in relation to FIG. 4, the interaction device 110 receives the user input data and provides mouse and keyboard signals to the local computer 102 so that the user inputs received at the remote computer 120 can be implemented by the local computer 102. The updated screen frames of the local computer 102 are then captured and transferred to the remote computer 120 for display so that the user can see that the user input has been implemented.

Figure 6:
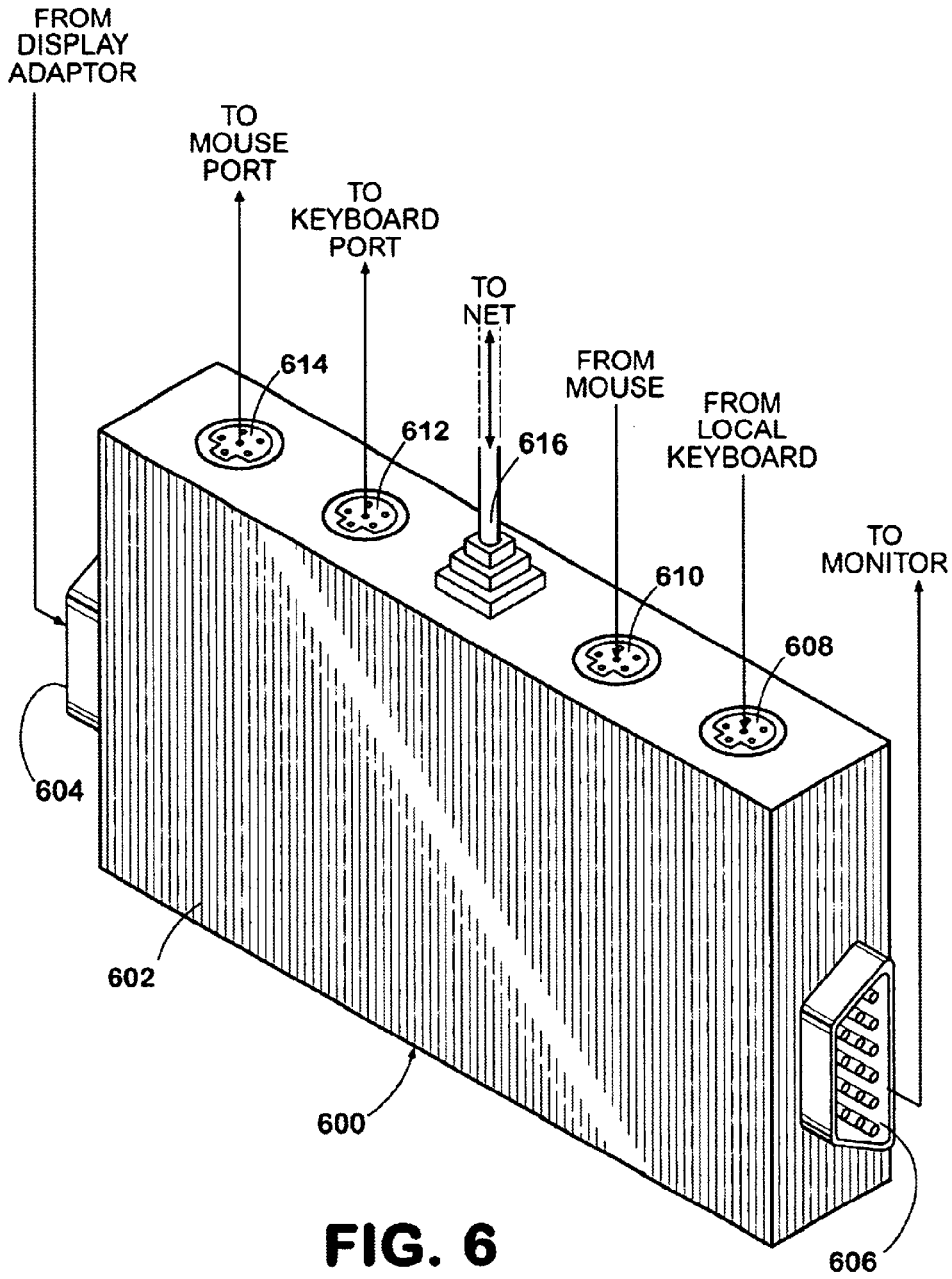
FIG. 6 is a perspective view of a device that is configured to be used externally of a local computer being remotely managed.

FIG. 6 shows a perspective view of an external implementation 600 of the interaction device 110. The external interaction device 600 includes an outer case 602 that provides several ports. A video input connector 604 is included for connection to a cable that is also connected to the external video connection of the local computer 102. The video input connector 604 receives the analog video output from the local computer 102 and passes the signal that is split between the analog to digital converter 202 and the video buffer 204. The output from the video buffer 204 is provided to a video output connector 606 that is connected to a cable of the display monitor 116 and enables the display monitor 116 to show the screen frames produced by the local computer 102.

The external interaction device 600 also includes a mouse input port 610 and keyboard input port 608 that are connected to the local mouse 112 and local keyboard 114, respectively. These ports 610, 612 channel signals to the switch 228 which then passes the signals to a mouse output port 614 and keyboard output port 612, respectively. The mouse output port 614 and keyboard output port 612 are connected to the mouse port 104 and keyboard port 108, respectively, of the local computer 102. These input and output ports for the mouse and keyboard may be PS/2 style ports, standard keyboard ports, standard serial ports, or other connection types known for a keyboard and mouse.

The external interaction device 600 also includes a network connection 616, such as a hardwired twisted pair cable for a direct network connection or a jack for receiving a cable. The network connection 616 links the external interaction device 600 to the network 118 and provides a bidirectional communication path for sending and receiving data, as discussed above.

Various power sources may be included for the device 600. On-board batteries and/or a wall adapter may be utilized to provide the DC voltage required by the circuitry described above. Furthermore, the device 600 may draw power from various connections made to the local computer 102, such as through the mouse or keyboard ports.

The external interaction device 600 allows the device 600 to be easily added to a local computer 102. Because all connections to the local computer 102 are external, the device 600 can be quickly and easily installed or removed. However, it should be appreciated that the interaction device 110 may be of various forms, including internal implementations where the device 110 is located inside the local computer 102 and one or more of the connections to the local computer 102 are made internally.

Figure 7:
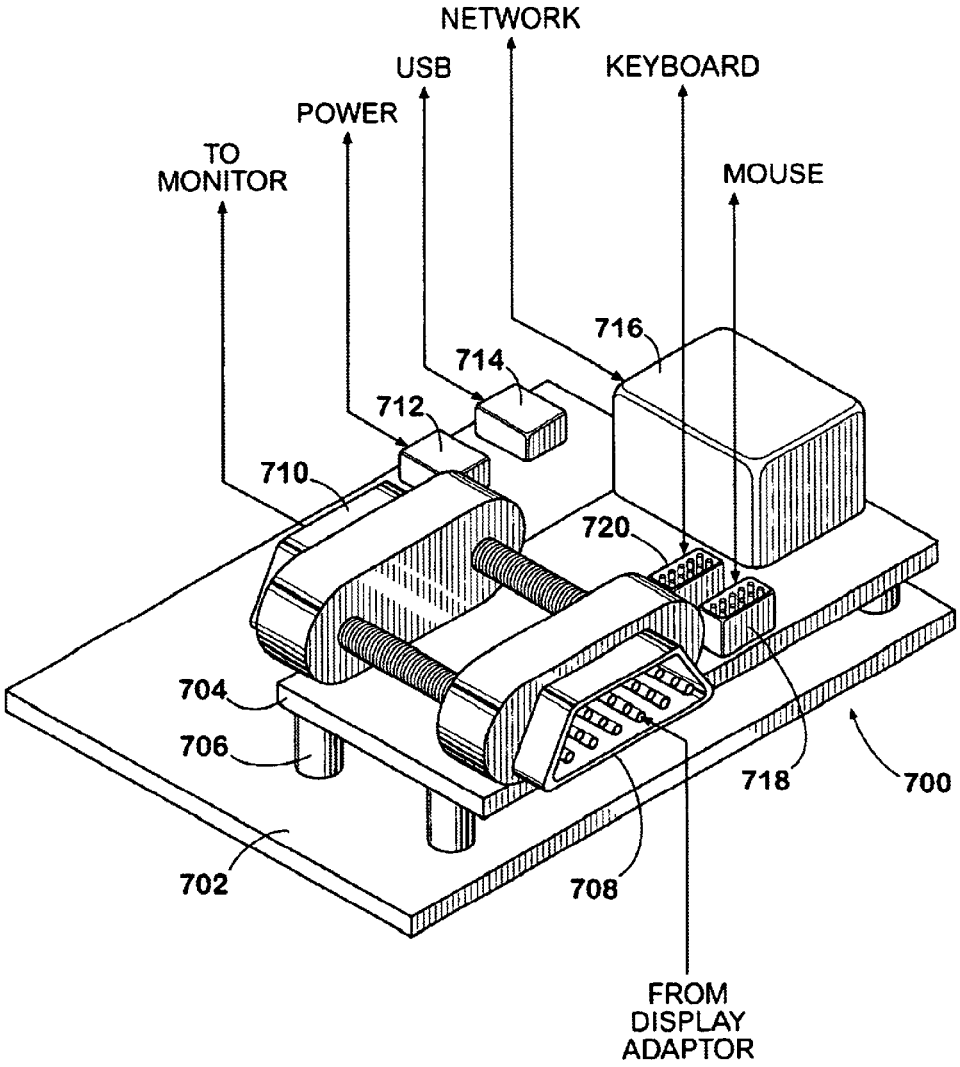
FIG. 7 is a perspective view of a second device that is configured to be used externally of a local computer being remotely managed.

FIG. 7 shows a perspective view of another physical embodiment 700 of the interaction device 110. This interactive device 700 has a condensed form that allows a video input connector 708 of the device 700 to be plugged directly into the video card of the local computer 102 without requiring a cumbersome video cable. The condensed form reduces the weight that would otherwise tend to unplug the device 110 from the video port of the local computer 102 when directly connected without a cable.

The device 700 includes a first printed circuit board 702 that provides a mounting surface for the logic devices such as the microcontroller 228, processor 220, SDRAM 208, 212, and 222, USB microcontroller 234, universal device controller 232, converter 202, and frame grabber 206, frame differentiator 210, and network interface chipset 226. The first printed circuit board 702 may also include a power jack 712 for connection to an external wall adapter and a USB port 714 for connection to a USB cable that connects to the USB port of the local computer 102.

To condense the form, a second printed circuit board 704 is suspended above the first board 702 by spacers 706. The board 704 supports various connectors such as the video input connector 708, video output connector 710, mouse connector 718, keyboard connector 720, and network connector 716. The connectors of the second printed circuit board 704 are electrically connected to the circuitry of the first printed circuit board 702 through patch wires (not shown) such as a flex tab circuit.

To further condense the form of the device 700, the mouse connector 718 and keyboard connector 720 may have a sufficient number of conductor pins to provide both an input connection for the local mouse and keyboard and an output connection for providing signals to the local computer 102. Thus, the cable(s) that plugs into the mouse connector includes wires that pass signals from the mouse to the connector 718 and also includes wires that pass signals from the mouse connector 718 to the mouse port of the local computer 102. Likewise, the cable(s) connected to the keyboard connector 720 also provide wires that pass signals between the keyboard and connector 720 and wires that pass signals between the connector 720 and the keyboard port of the local computer 102.

Embodiments of the present invention, as shown in FIGS. 8–12, may work in conjunction with the interaction device 700 of FIG. 7 and other external devices to simplify the connections between the local input device(s), the interaction device, and the local computer and to reduce the cable clutter that may result from other connection schemes. The embodiments of the present invention provide a pass-through style adapter that plugs into the input connector of the local computer and allows the local input device to be plugged into the adapter. This results in the local input device(s) being plugged in at nearly the same physical location that they would be plugged in had the interaction device not been present. Furthermore, embodiments of the present invention prevent cable clutter by utilizing a single cable to provide the link between the connection of a local input device, the connection of the interaction device, and the input connection of the computer.

Figure 8:
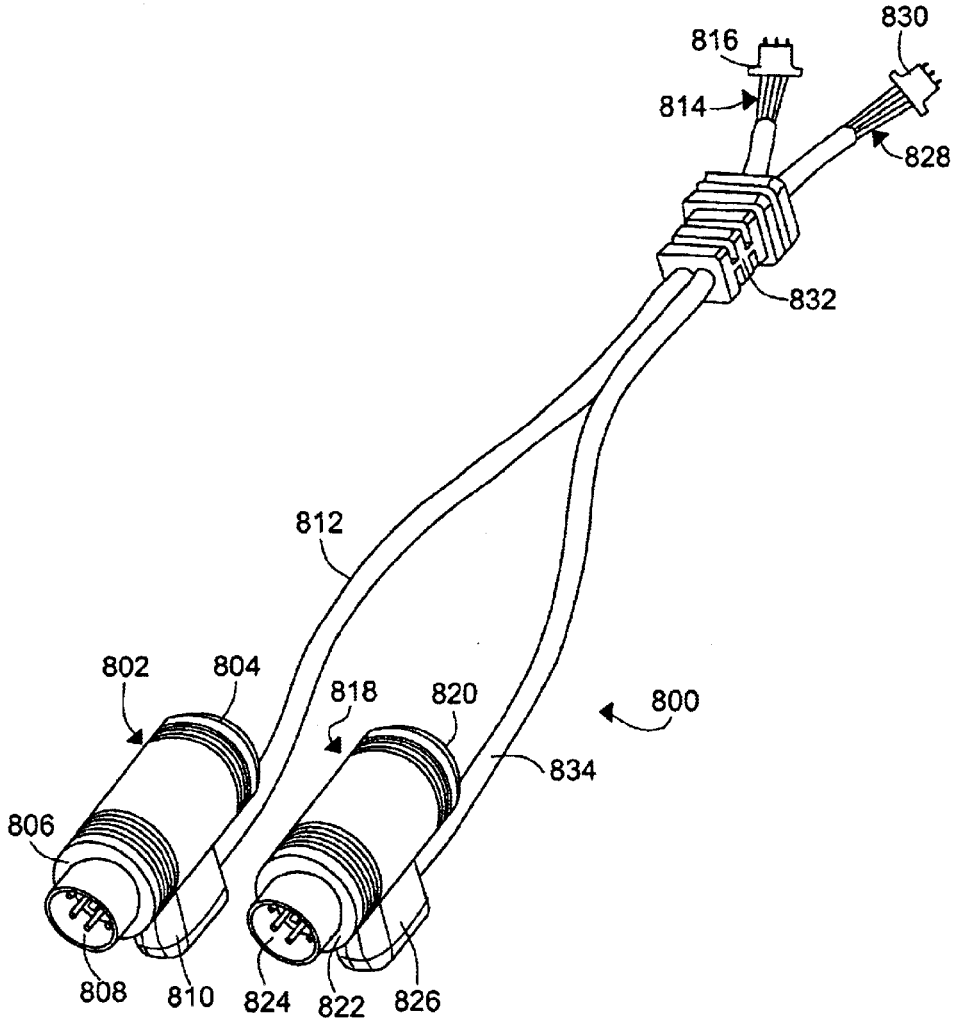
FIG. 8 shows one embodiment of an adapter that can be used in conjunction with the device of FIG. 7 to provide signal transfer between two local input devices, the interaction device of FIG. 7, and the local computer.

FIG. 8 shows one embodiment of an adapter. This embodiment utilizes well-known PS/2 connectors and provides for different PS/2 input devices such as a keyboard and a mouse. It will be appreciated that other connector types such as USB may also be utilized for the adapter and that the adapter may be set up for any number of devices rather than just for two devices as is shown in FIG. 8.

The adapter 800 of FIG. 8 has a first housing 802 that has one end 804 and another end 806. The end 804 has a connector that is not visible in this view but is for engaging the connector of the local input device. At the other end 806, the adapter 800 has a connector 808 for engaging the input connector of the local computer. In this embodiment, the housing 802 includes an extension 810 that allows the wiring to extend from the interior of the housing 802 to the cable 812 that leads away from the housing 802. The cable 812 carries the individual wires 814 that are in electrical continuity with the conductive pins of the connectors on each end of the housing 802. The individual wires 814 may be terminated at another connector 816. This connector 816 may be a mate to the connectors 716 and 720 of the interaction device of FIG. 7 such that signals from the local input device are channeled through the adapter 800 to the interaction device and signals from the interaction device are channeled through the adapter 800 to the local computer.

The adapter 800 of FIG. 8 also has a second housing 818 that has one end 820 and another end 822. The end 820 has a connector that is not visible in this view but is for engaging the connector of the next local input device. At the other end 822, the adapter 800 has a connector 824 for engaging the input connector of the local computer. In this embodiment, the housing 818 includes an extension 826 that allows the wiring to extend from the interior of the housing 818 to the cable 834 that leads away from the housing 818. The cable 834 carries the individual wires 828 that are in electrical continuity with the conductive pins of the connectors on each end of the housing 818. The individual wires 828 may be terminated at another connector 830. This connector 830 may be a mate to the connectors 716 and 720 of the interaction device of FIG. 7 such that signals from the local input device are channeled through the adapter 800 to the interaction device and signals from the interaction device are channeled through the adapter 800 to the local computer.

The two cables 812 and 834 may be joined together at some point between the housings 802 and 818 and the end connectors 816 and 830 where is it desirable to have a unified adapter 800 rather than two individual adapters each having a single housing. To further unify the two separate housings and cables of the adapter 800, a relief junction 832 is provided at the point where the two cables are joined. This relief may be placed at the intersection of the cables 812, 834 with a housing of the interaction device, if any, to reduce the forces on the cables 812 and 834 that might otherwise unplug one or more of the connectors or break a wire free from a connector. It will be appreciated that in other embodiments where two or more local devices are in use involving two or more inputs to the computer, the single housing may accommodate two or more pairs of connectors as opposed to the single housing per pair of connectors as shown in FIG. 8.

Various materials may be used for the adapter. The housing may be made of plastic or other material that provides the structural support for the connectors at each end. Furthermore, the housing(s) of the adapter may be color coded to simplify the connections to the input port of the computer and to the local input device. For example, it is known to color code a PS/2 input port for a mouse with standard color and color code a PS/2 input port for a keyboard with a different standard color. The connectors of the input devices are color coded to correspond with the input ports so that the correct input device connector is connected to the correct input port. The housing(s) of the adapter may be color coded with these same standard colors to further simplify the connection process.

Figure 9:
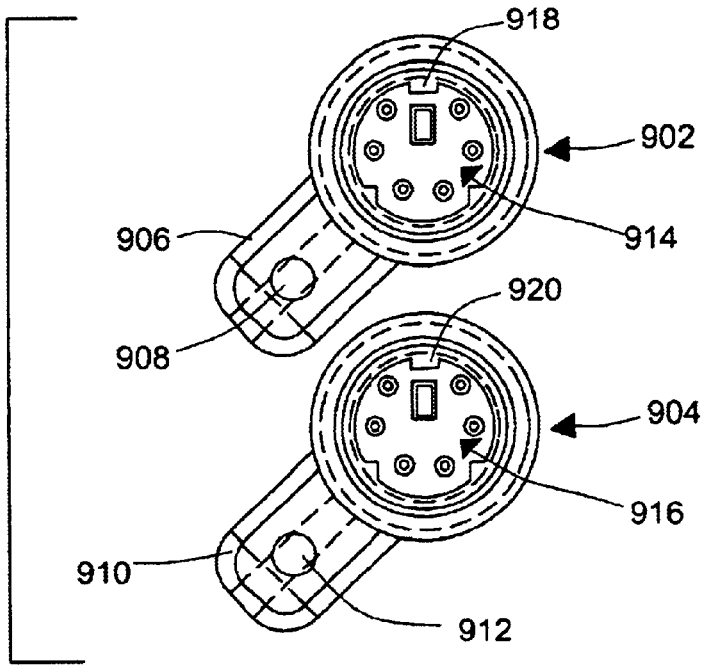
FIG. 9 shows one end of the two housings of the adapter embodiment of FIG. 7 where the one end of each housing has a connector that mates to the connector of an input device.
Figure 10:
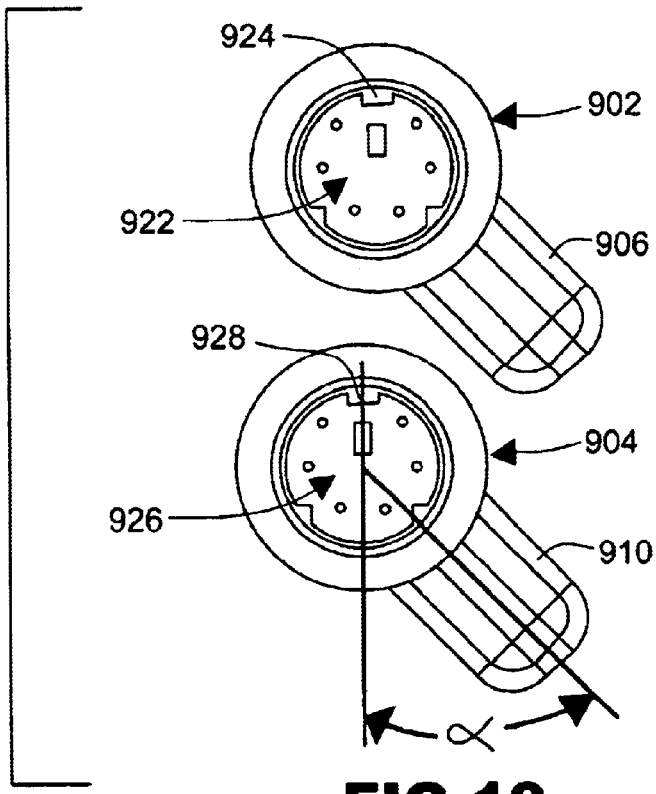
FIG. 10 shows another end of the two housings of the adapter embodiment of FIG. 7 where this other end of each housing has a connector that mates to the input connector of the local computer.

FIG. 9 shows a view of two housings of an adapter positioned as though the connectors of the housings are plugged into input connectors of the local computer. This view is of the end that is away from the local computer. FIG. 10, discussed below, provides the view of the end of the housings that would be plugged into the computer. Housing 902 provides connector 914 and housing 904 provides connector 916 for engaging the connectors of the local input devices. Additionally, housing 902 provides an extension 906 and cable 908 while housing 904 provides an extension 910 and cable 912.

Typically, the mouse and keyboard PS/2 ports of a computer are closely stacked or are side-by-side and are positioned such that they are in alignment with a reference point of the input port that requires that the input devices be properly plugged in. The PS/2 connector 914 has one or more reference points 918 that matches reference points of the PS/2 connector of the local input device to allow the two to properly engage. Likewise, connector 916 has one or more reference points 920 that matches reference points of the PS/2 connector of the local input device to allow the two to properly engage. The extension 906 of housing 902 and extension 910 of housing 904 extend at an angle relative to the reference such that an extension does not interfere with the other housing. In this example of FIG. 9, extension 906 extending from housing 902 at an angle relative to the reference 918 prevents interference with housing 904 which is located closely below housing 902. This angle is shown in more detail in FIG. 10.

FIG. 10 shows the end of the housings 902 and 904 that would plug into the input ports of the local computer. Housing 902 provides a connector 922 with a reference point 924 while housing 904 provides a connector 926 with a reference point 928. As can be seen the extensions 906 and 910 of the two housings extend from the housings at an angle $\alpha$ from the plane created by the reference point of the connectors 922, 926. This angle is large enough so that the extension 906 does not interfere with the housing 904 upon the connectors being plugged into the input ports of the local computer.

Figures 11, 12:
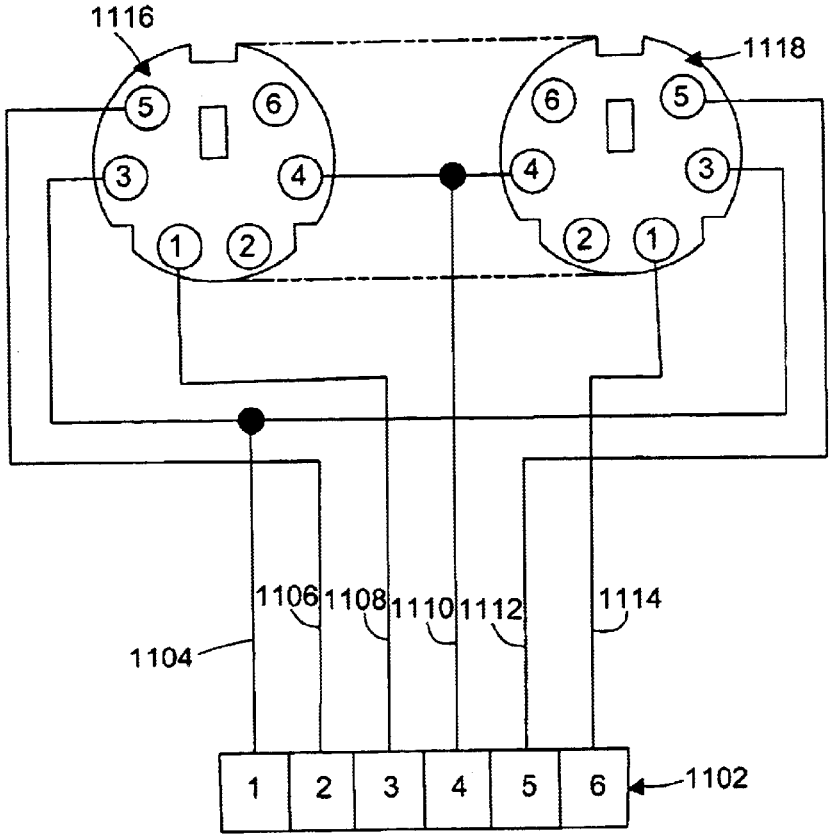
FIG. 11 shows the pin connections of the connectors on each end of a housing of an embodiment of the adapter that utilizes conventional PS/2 connections.
FIG. 12 is a table that provides the pin definitions for the adapter embodiment utilizing the conventional PS/2 connections.

FIG. 11 shows the wiring diagram of the two PS/2 connectors, one male and one female, of an embodiment of an adapter. FIG. 12 is a table of the typical pin definitions for a PS/2 connector. The male connector 1116 and female connector 1118 have six conductive pins each. However, for the typical PS/2 pin definitions, pins 2 and 6 of each connector are not connected to anything.

The pin definitions and connections are as follows. Pin 1 of the male connector 1116 is for carrying host data being directed between the local computer and external device and is in continuity with a wire 1108 that leads to a pin 3 of a connector 1102 that mates to a connector of the external device such as the interaction device 700 of FIG. 7. Pin 1 of the female connector 1118 carries a local data being directed between the external device and the local input device and is in continuity with a wire 1114 that leads to a pin 6 of connector 1102. Pin 3 of the male connector 1116 and pin 3 of the female connector 1118 are at ground as provided from the local computer and are in continuity with a wire 1104 that leads to a pin 1 of connector 1102. Pin 4 of the male connector 1116 and pin 4 of the female connector 1118 are positive 5 volts as provided from the local computer and are in continuity with a wire 1110 that leads to a pin 4 of connector 1102. Pin 5 of the male connector 1116 carries a host clock signal between the local computer and the external device and is in continuity with a wire 1106 that leads to a pin 2 of the connector 1102. Pin 5 of the female connector 1118 carries a local clock signal between the external device and the local input device and is in continuity with a wire 1112 that leads to a pin 5 of the connector 1102.

Upon the adapter being plugged into the input port of the computer and the input connector of the external device, the external device is able to provide input signals to the computer, such as input signals that are received remotely through a network connection of the external device. Upon also connecting a local input device to the adapter, input signals from the local input device are directed through the adapter to the external device which may then forward the input signals back through the adapter to the local computer.

Although the present invention has been described in connection with various illustrative embodiments, those of ordinary skill in the art will understand that many modifications can be made thereto within the scope of the claims that follow. Accordingly, it is not intended that the scope of the invention in any way be limited by the above description, but instead be determined entirely by reference to the claims that follow.

What is claimed is:

1. An adapter for use between a computer and a computer input device, comprising:

a first connector housing;

a first connector on a first end of the housing, the first connector including at least one conductor and being connectable to a connector of a computer;

a second connector on a second end of the housing, the second connector including at least one conductor not connected to the first connector and being connectable to a connector of a computer input device; and a cable extending from the first connector housing, wherein the cable includes a first wire in electrical continuity with the at least one conductor of the first connector and wherein the cable includes a second wire in electrical continuity with the at least one conductor of the second connector.

2. The adapter of claim 1, wherein the second connector is a mate to the first connector.

3. The adapter of claim 2, wherein the first connector and second connector are PS/2 connectors.

4. The adapter of claim 1, wherein the first connector has a reference for controlling a connection position of the first connector relative to a first connector of the computer and wherein the cable extends from a point at the first connector housing that is at an angle relative to the reference such that when the first connector is connected to the first connector of the computer, the cable extending from the housing will not interfere with a second connector of the computer that is positioned proximate to the first connector along a horizontal or vertical axis extending through the first connector.

5. The adapter of claim 1, further comprising:

a second connector housing;

a third connector on a first end of the second connector housing, the third connector including at least one conductor and being connectable to a second connector of a computer;

a fourth connector on a second end of the second housing, the fourth connector including at least one conductor and being connectable to a second connector of a computer input device; and a second cable extending from the second connector housing, wherein the second cable includes a first wire in electrical continuity with the at least one conductor of the third connector, wherein the second cable includes a second wire in electrical continuity with the at least one conductor of the fourth connector, and wherein the first cable and second cable are fixed together at at least one point.

6. The adapter of claim 1, further comprising:

a device connector at the end of the cable opposite the first connector housing, wherein the device connector has at least a first and second conductor and wherein the first wire of the cable is in electrical continuity with the first conductor of the device connector and the second wire of the cable is in electrical continuity with the second conductor of the device connector.

7. A computer system, comprising:

a computer having at least one input connector;

an input device having at least one connector;

an adapter that comprises:

a first connector housing;

a first connector on a first end of the housing, the first connector including at least one conductor and being connected to the at least one connector of the computer;

a second connector on a second end of the housing, the second connector including at least one conductor not connected to the first connector and being connected to the at least one connector of the input device; and a cable extending from the first connector housing, wherein the cable includes a first wire in electrical continuity with the at least one conductor of the first connector and wherein the cable includes a second wire in electrical continuity with the at least one conductor of the second connector.

8. The computer system of claim 7, further comprising:

a network device connected to a network and including a connector that receives first input signals through the connector and sends third input signals through the connector, and wherein the network device receives second input signals through the network; and wherein the adapter further comprises a third connector on a second end of the cable opposite from the first end with a first conductor of the third connector in electrical continuity with the first wire of the cable and a second conductor of the third connector in electrical continuity with the second wire of the cable, and wherein the third connector is connected to the connector of the network device such that the first input signals are generated by the input device and are transferred through the second wire of the cable to the network device and the third input signals from the network device is transferred through the first wire of the cable to the input connector of the computer.

9. The computer system of claim 7, wherein the second connector is a mate to the first connector.

10. The computer system of claim 7, wherein the first connector and second connector are PS/2 connectors.

11. The computer system of claim 7, wherein the first connector has a reference for controlling a connection position of the first connector relative to the input connector of the computer and wherein the cable extends from a point at the first connector housing that is at an angle relative to the reference such that when the first connector is connected to the first connector of the computer, the cable extending from the housing will not interfere with a second connector of the computer that is positioned proximate to the first connector along a horizontal or vertical axis extending through the first connector.

12. The computer system of claim 7, further comprising:

a second input connector of the computer;

a second input device having a connector; and wherein the adapter further comprises:

a second connector housing;

a third connector on a first end of the second connector housing, the third connector including at least one conductor and being connected to the second input connector of the computer;

a fourth connector on a second end of the second housing, the fourth connector including at least one conductor and being connected to the connector of the second computer input device; and a second cable extending from the second connector housing, wherein the second cable includes a first wire in electrical continuity with the at least one conductor of the third connector, wherein the second cable includes a second wire in electrical continuity with the at least one conductor of the fourth connector, and wherein the first cable and second cable are fixed together at at least one point.

13. A method of passing input signals between a local input device, an external device, and a computer, comprising:

providing an adapter having a first housing with a first connector, a second connector, a cable with a first wire associated with the first connector and a second wire associated with the second connector, wherein the first connector is connected to an input connector of the computer, wherein the second connector is connected to a connector of the input device, and wherein the first wire and second wire are in electrical continuity with circuitry of the external device;

transferring an input signal from the local input device through the second connector to only the second wire; and transferring an input signal from the external device through the first wire to only the first connector.

14. The method of claim 13, wherein the second connector is a mate to the first connector.

15. The method of claim 14, wherein the first connector and second connector are PS/2 connectors.

16. The method of claim 13, further comprising:

inserting the first connector into the input connector of the computer, wherein the first connector has a reference for controlling a connection position of the first connector relative to the connector of the computer upon the first connector being inserted and wherein the cable extends from the first connector housing at an angle relative to the reference such that when the first connector is connected to the first connector of the computer, the cable extending from the housing will not interfere with a second connector of the computer that is positioned proximate to the first connector along a horizontal or vertical axis extending through the first connector; and inserting the connector of the input device into the second connector.

17. The method of claim 13, wherein the external device is a network device that receives a signal from a network and generates the input signal transferred through the first wire from the signal from the network.

18. An adapter for use between a computer and a computer input device, comprising:

a first connector housing;

a first connector on a first end of the housing, the first connector including at least one conductor and being connectable to a connector of a computer;

a second connector on a second end of the housing, the second connector including at least one conductor and being connectable to a connector of a computer input device;

a cable extending from the first connector housing, wherein the cable includes a first wire in electrical continuity with the at least one conductor of the first connector and wherein the cable includes a second wire in electrical continuity with the at least one conductor of the second connector;

a second connector housing;

a third connector on a first end of the second connector housing, the third connector including at least one conductor and being connectable to a second connector of a computer;

a fourth connector on a second end of the second housing, the fourth connector including at least one conductor and being connectable to a second connector of a computer input device; and a second cable extending from the second connector housing, wherein the second cable includes a first wire in electrical continuity with the at least one conductor of the third connector, wherein the second cable includes a second wire in electrical continuity with the at least one conductor of the fourth connector, and wherein the first cable and second cable are fixed together at at least one point.

19. A computer system, comprising:

a computer having at least one input connector;

an input device having at least one connector;

an adapter that comprises a first connector housing, a first connector on a first end of the housing, the first connector including at least one conductor and being connected to the at least one connector of the computer, a second connector on a second end of the housing, the second connector including at least one conductor and being connected to the at least one connector of the input device, and a cable extending from the first connector housing, wherein the cable includes a first wire in electrical continuity with the at least one conductor of the first connector and wherein the cable includes a second wire in electrical continuity with the at least one conductor of the second connector;

a network device connected to a network and including a connector that receives first input signals through the connector and sends third input signals through the connector, and wherein the network device receives second input signals through the network; and wherein the adapter further comprises a third connector on a second end of the cable opposite from the first end with a first conductor of the third connector in electrical continuity with the first wire of the cable and a second conductor of the third connector in electrical continuity with the second wire of the cable, and wherein the third connector is connected to the connector of the network device such that the first input signals are generated by the input device and are transferred through the second wire of the cable to the network device and the third input signals from the network device is transferred through the first wire of the cable to the input connector of the computer.

20. A computer system, comprising:

a computer having at least a first and second input connector;

a first and second input device, each having at least one connector; and an adapter that comprises a first connector housing, a first connector on a first end of the housing, the first connector including at least one conductor and being connected to the first input connector of the computer, a second connector on a second end of the housing, the second connector including at least one conductor and being connected to the at least one connector of the first input device, a cable extending from the first connector housing, wherein the cable includes a first wire in electrical continuity with the at least one conductor of the first connector and wherein the cable includes a second wire in electrical continuity with the at least one conductor of the second connector, a second connector housing, a third connector on a first end of the second connector housing, the third connector including at least one conductor and being connected to the second input connector of the computer, a fourth connector on a second end of the second housing, the fourth connector at least one conductor and being connected to the at least one connector of the second input device, and a second table extending from the second connector housing, wherein the second cable includes a first wire in electrical continuity with the at least one conductor of the third connector, wherein the second cable includes a second wire in electrical continuity with the at least one conductor of the fourth connector, and wherein the first cable and second cable are fixed together at at least one point.

* * * * *